United States Patent [19]

Buran et al.

[11] 4,072,175

[45] Feb. 7, 1978

[54] LOOM WITH MEANS FOR SHED FORMING

[75] Inventors: Vojtech Buran; Vladimir Horn, both of Brno, Czechoslovakia

[73] Assignee: Vyzkumny a vyvojovy ustav Zavodu vseobecneho strojirenstvi, Brno, Czechoslovakia

[21] Appl. No.: 671,588

[22] Filed: Mar. 29, 1976

[30] Foreign Application Priority Data

Mar. 28, 1975 Czechoslovakia ..... 2147/75

[51] Int. Cl.[2] ..... D03C 13/00; D03C 17/06; D03D 47/26

[52] U.S. Cl. ..... 139/455; 139/319; 139/436

[58] Field of Search ..... 139/55 R, 55 A, 55 B, 139/436, 59, 319, 317, 55.1, 455, 456; 66/50 R, 75 A, 154 A, 75.2, 154

[56] References Cited

U.S. PATENT DOCUMENTS

| | | | |
|---|---|---|---|
| 3,262,285 | 7/1966 | Beguin et al. | 66/154 A |
| 3,472,287 | 10/1969 | Ribler | 139/319 |
| 3,499,473 | 3/1970 | Fend et al. | 139/59 |
| 3,605,448 | 12/1971 | Ribler | 66/154 A |
| 3,618,640 | 11/1971 | Linka | 139/436 X |
| 3,812,691 | 5/1974 | Engelfried | 66/50 R |

FOREIGN PATENT DOCUMENTS

| | | | |
|---|---|---|---|
| 75,278 | 8/1970 | Germany | 139/436 |
| 2,120,583 | 11/1971 | Germany | 139/436 |
| 2,202,470 | 7/1973 | Germany | 139/436 |
| A81,084 | 6/1963 | France | 139/436 |

*Primary Examiner*—James Kee Chi

[57] ABSTRACT

A loom with shed forming means including healds, of which at least the carrier parts are displaceably mounted in guiding grooves formed in a bed extending along the whole machine width, at least one control mechanism being assigned to said carrier parts of the healds, said control mechanism being movably mounted on a guideway parallel to said bed. The control mechanism includes a selecting mechanism and a resetting mechanism. The selecting mechanism is preferably formed by a selecting magnet with a guiding means therefor.

The loom of the invention may be one with progressive shed forming, or one with single shed forming.

25 Claims, 29 Drawing Figures

LOOM WITH MEANS FOR SHED FORMING

The present invention relates to a loom with means for shed forming.

There are known devices for shed forming which include separate heald shafts controlled by a patterning device in accordance with a program punched in patterning cards. Devices are also known in which separate warp threads are controlled in accordance with a program punched in cards, a patterning belt or tape, or in a power card. Both types of device are disadvantageous in that the opening and closing of the shed is performed simultaneously along the whole width of the machine, and thus it is not possible to form a progressive shed.

There are also known devices for forming a progressive shed, that is, for controlling warp threads or groups thereof, in which such operation is performed e.g. by a cam system. These devices permit the weaving of only a predetermined weave which cannot be changed during operation of the machine.

The present invention has among its objects the substantial mitigation of the above disadvantages, and the provision of a method of and an apparatus for forming a progressive shed, thus permitting the manufacture of a fabric of whatever weave is desired.

Looms in accordance with preferred embodiments of the present invention include healds, of which at least the carrier parts are displaceably mounted in guiding grooves formed in a bed along the whole width of the machine, at least one control mechanism being assigned to said carrier parts of the healds, said control mechanism being displaceably arranged on a guideway parallel to said bed.

The control mechanism includes a selecting mechanism formed by a selecting magnet together with a guiding means therefor, and a resetting mechanism formed by cam paths provided on the control mechanism at the part thereof adjacent to the plane of movement of the healds.

From the viewpoint of reliability of selection, it is advantageous to form the selecting magnet by combining at least one permanent magnet and at least one electromagnet coupled with a programming device.

It is advantageous from the viewpoint of simplicity to weaken the carrier part of the healds in its middle part and to make at least this middle part from resilient material, or to provide said carrier part with a control lifter functioning as the connection thereof to the control mechanism.

For supplying the control mechanism with electric power said control mechanism is provided with sensing contacts which are connected to electric conductors arranged parallelly to the guideway of said control mechanism; said electric conductor may be formed by e.g. a conductive liquid, into which the sensing contacts of said control mechanism are dipped.

For driving the control mechanism, each control mechanism is provided with a pulling means connected to a driving means.

For the purpose of simplifying the construction of the cam paths of the displacing mechanism, it is advantageous to form the cam paths by cam projections of which the initial parts are overlapped in the direction of guiding of the control mechanism, the cam paths diverging in the direction from the front towards the rear end of the control mechanism, being substantially parallel in their middle parts, and approaching each other in the rear part.

In accordance with the present invention, the control mechanism includes a carrier body and a bent bracket attached thereto, the inner walls of which are mutually parallel, the displacing mechanism (resetting mechanism) being formed by cam paths arranged on two oppositely arranged inner walls of the control mechanism, the lower part of a control lifter engaging the space between those inner walls, said control lifter being provided with two mutually oppositely directed butts.

Preferably on one inner wall of the control mechanism there is arranged a lifting path and a selecting magnet, while on the oppositely situated inner wall there is arranged a sinking path and a guiding path, said sinking path being provided at its upper part with a step, while said guiding path is provided at its operative part with a projection the shape of which corresponds to the shape of the projection of the control lifter butt adjacent thereto.

The main advantage of the present invention consists above all in making it possible to form a progressive shed in the loom for manufacturing a fabric of whatever weave is desired, together with making possible its application to looms which insert weft threads by means of picking shuttles, grippers etc.

Preferred illustrative embodiments of the present invention are shown in the accompanying drawings, of which:

Figure 23:
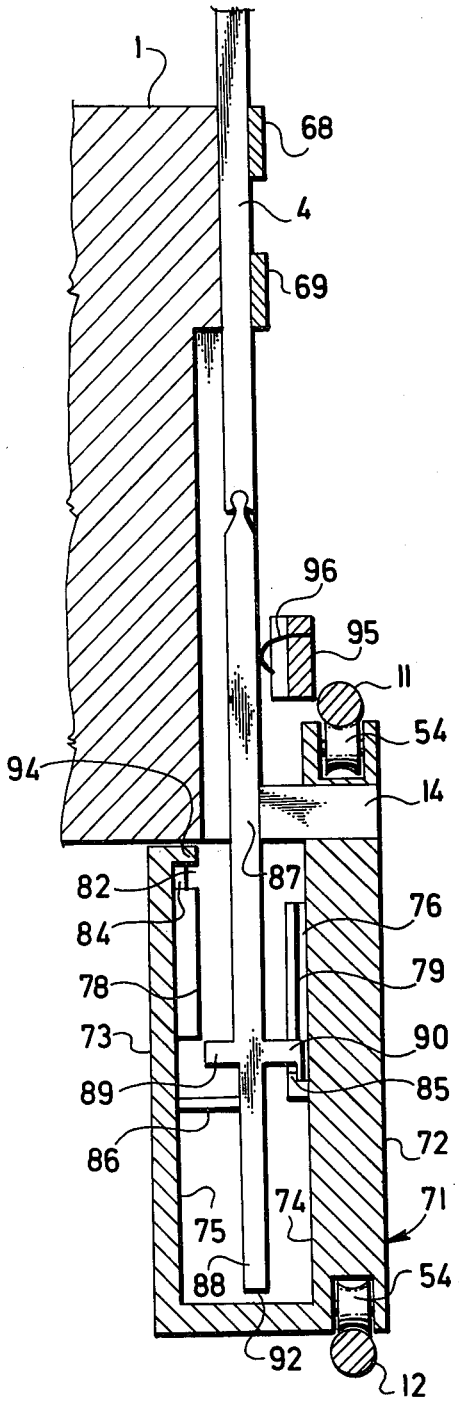
Figure 24:
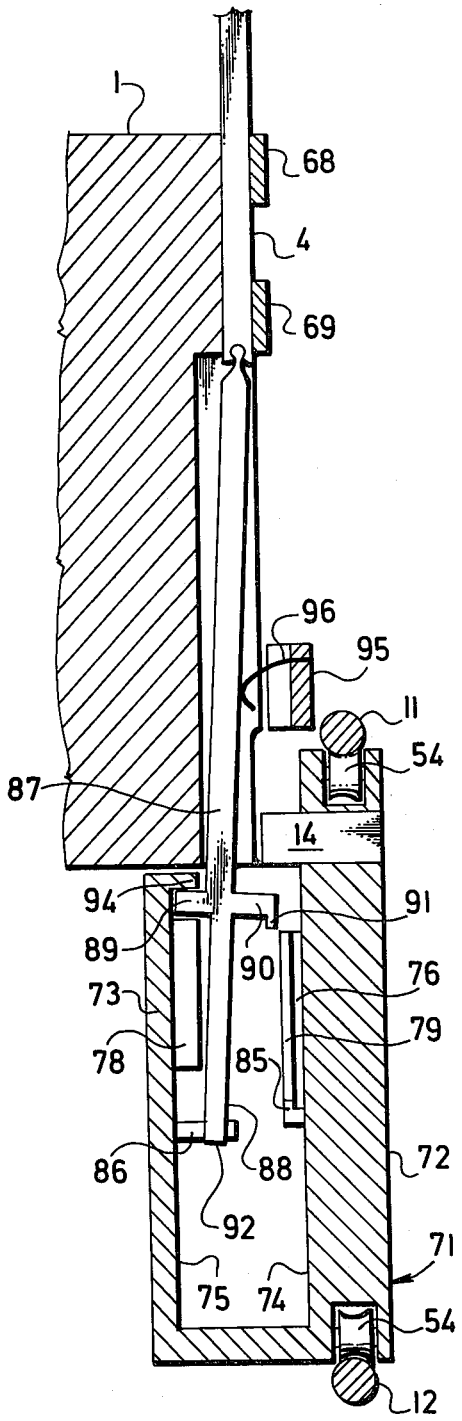
Figure 25:
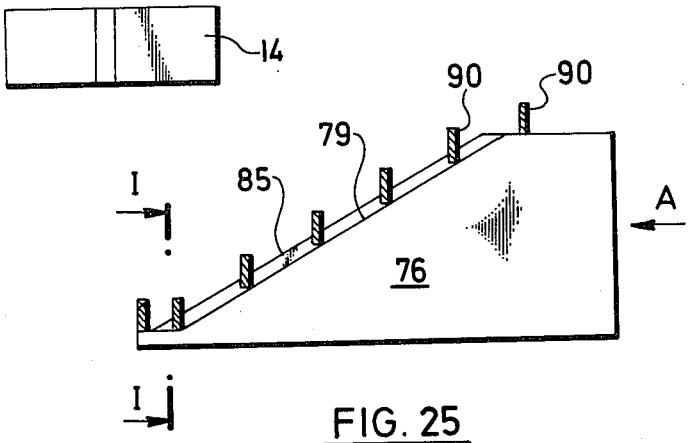
Figure 27:
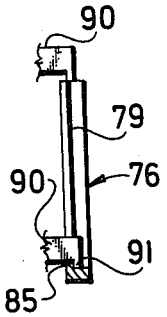
Figure 26:
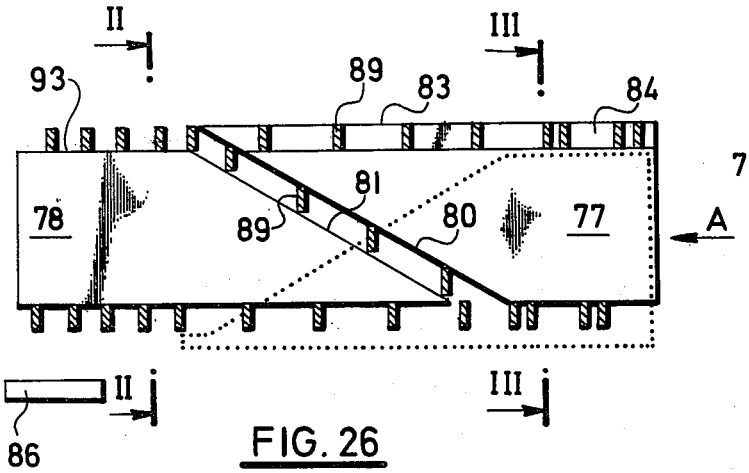
Figure 28:
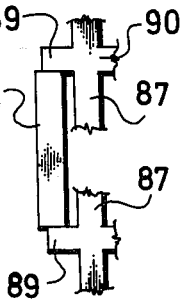

FIGS. 23 to 29, incl., illustrate an embodiment which permits the selection of warp threads in the extreme shedding positions thereof;

FIG. 23 is a view in cross section of the device at the phase at which the appurtenant warp thread is in the lower plane of the shed;

FIG. 24 is a view in cross section through the device at the phase at which the appurtenant warp thread is in the upper plane of the shed;

FIG. 25 illustrates the cam path for lifting the healds;

FIG. 26 illustrates the cam path for drawing down the healds and shows the position of the cam path for lifting the healds;

FIG. 27 is a view in section taken along the line 1—1 in FIG. 25;

FIG. 28 is a view in section taken along the line 11—11 in FIG. 26; and

Figure 29:
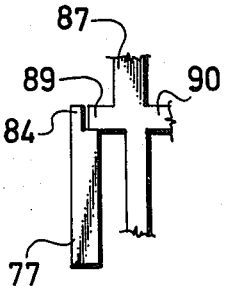

FIG. 29 is a view in section taken along the line III—III in FIG. 26.

The shed is formed, according to the present invention, by the progressive guiding of warp threads in an arbitrary, predetermined sequence into the upper and lower shedding plane.

Figure 1:
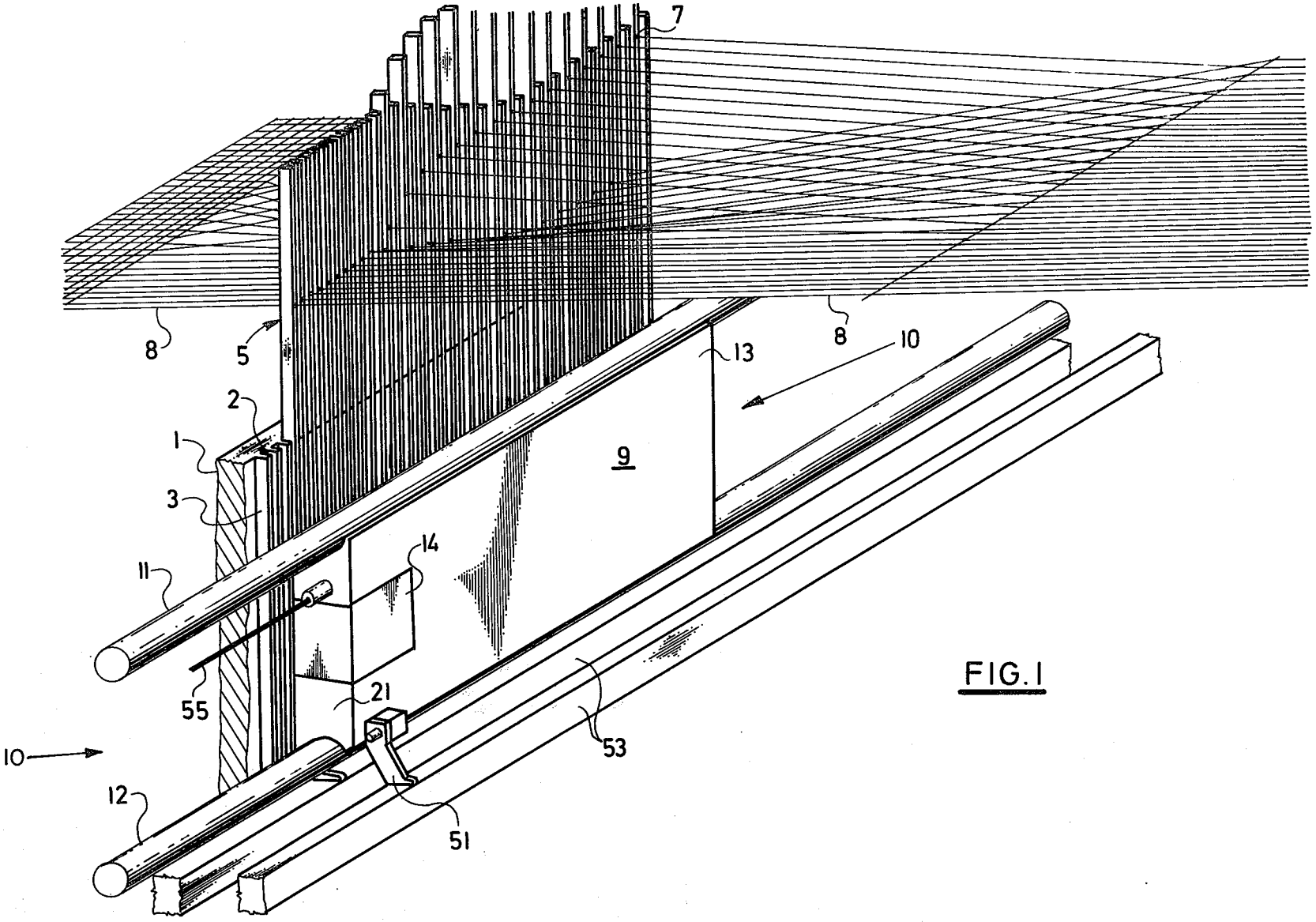
FIG. 1 is an overall view in perspective of the apparatus according to the present invention.

Turning now to FIG. 1, in a loom frame (not shown) there is stationarily mounted a bed 1 in which there are provided grooves 2 which extend vertically and are uniformly spaced, said grooves being separated from each other by separate ribs 3. Bed 1 extends across the entire width of the loom. In grooves 2 there are displaceably arranged the carrier parts of healds 5. In one preferred embodiment, each heald 5 is provided with a carrier part 4 which, together with said heald 5, forms an integral part with a constant cross section along its whole length.

Figure 22:
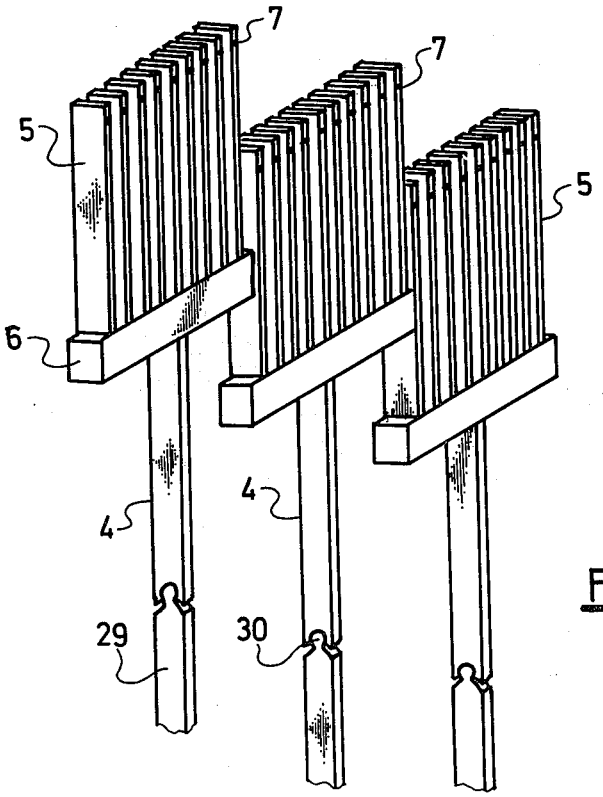
FIG. 22 is a view in perspective of a group of the healds.

According to another embodiment, shown in FIG. 22, one carrier part 4 is common to a group of healds 5. On the carrier part 4 perpendicularly thereto there is mounted a carrier 6 on which are arranged healds 5. the regular spacing of healds 5 is maintained on carrier 6 and is also maintained between the end healds 5 of adjacent carriers 6.

In any embodiment, on each heald 5 there is provided a guiding eyelet 7, through which the appurtenant warp thread 8 passes. The guiding eyelet 7 is always disposed in that part of the heald 5 which lies outside groove 2 of bed 1 and which does not travel into said groove 2 at any phase of operation of the loom.

At least one control mechanism 9 is attached to the carrier parts 4 of healds 5, mechanism 9 is mounted displaceably on guideway 10, parallel to bed 1. Guideway 10 consists substantially of two guiding rods 11, 12 which are longer than the width of the loom. The length of said guiding rods 11, 12 either exceeds the width of the weaving loom for a certain length, or they form a closed path with reversing arcs and a backward guideway (not shown). Guideway 10 is either arranged stationarily or is tiltable from bed 1.

Figure 2:
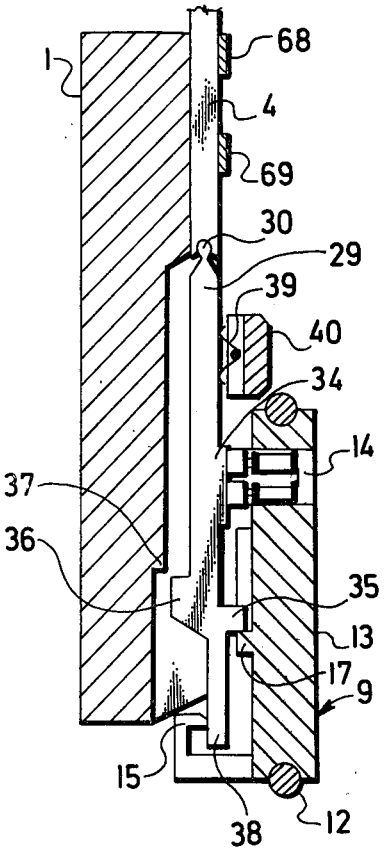
FIGS. 2 and 3 are cross sections of the apparatus at different phases of its operation.
Figure 4:
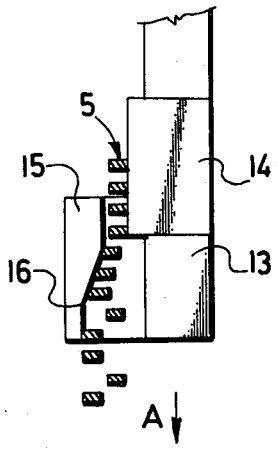
FIGS. 4 and 5 are plan views of the selecting magnet, control parts being shown in partial section.
Figure 7:
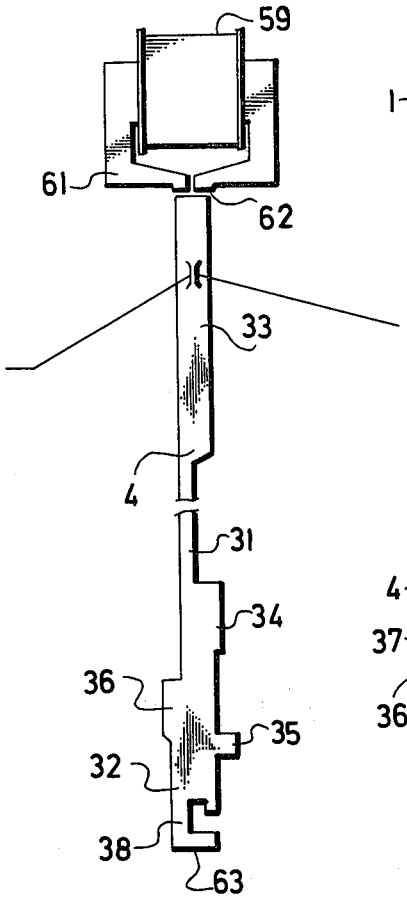
FIG. 7 is a cross section of the apparatus in the embodiment thereof provided with a prolonged carrier part of the healds.
Figure 7:
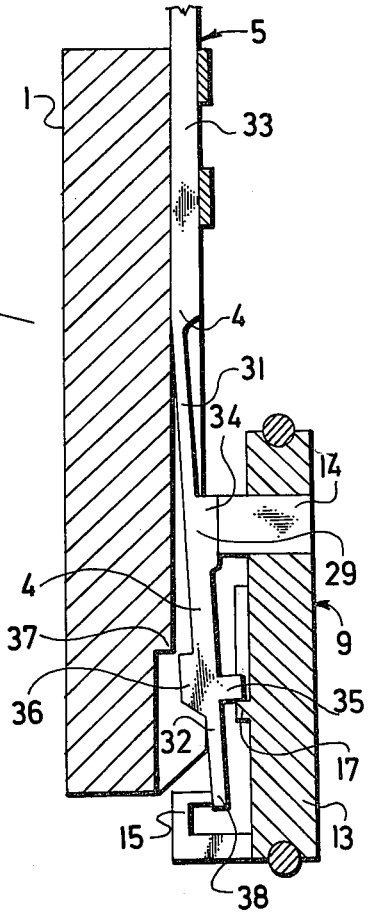

Control mechanism 9 includes a carrier body 13, on which there is mounted a selecting mechanism and a resetting mechanism. The selecting mechanism is formed by a selecting magnet 14 and a guiding means therefor, which is made in this exemplary embodiment, in the form of a shaped guide 15. This guide 15 is fixed to the carrier body 13 of control mechanism 9, as shown in FIGS. 2 and 7. Between the active surface 16 of guide 15 (FIG. 4) and carrier body 13, there is a gap which extends in the direction A of the operative movement of control mechanism 9.

The resetting mechanism is formed by cam paths provided in the control mechanism 9 on that part of carrier body 13 which is adjacent to the plane of movement of healds 5.

The cam paths have a common section in the direction of guideway 10 in the middle position, from which there diverge two cam paths, one path thereof leading to the upper position and another cam path leading to the lower position, after which the two paths lead back into the middle position. Selecting magnet 14 and the guide 15 attached thereto are arranged at the point of common section of the two cam paths at the middle position.

Figure 6:
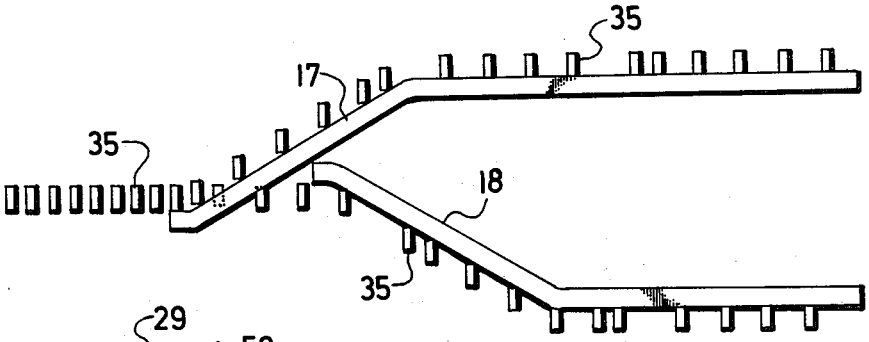
FIG. 6 is a diagram representation of the cam path of the control mechanism.
Figure 13:
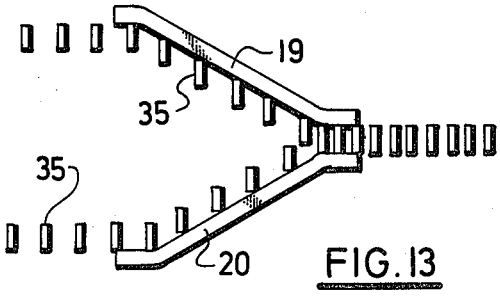
FIG. 13 is a diagrammatic representation of the end part of the cam paths on the control mechanism.

According to the embodiment shown in FIGS. 6 and 13 cam paths are formed by cam projections 17 to 20 on the carrier body 13 of the control mechanism 9. In the direction from the front 21 of control mechanism 9 to its rear end, cam projections 17, 18 diverge (FIG. 6) and are substantially parallel in their middle position. In the rear part of control mechanism 9 there are arranged cam projections 19 and 20, which approach each other as shown in FIG. 13. The said cam paths may be made according to the illustrative embodiment, i.e. wherein both the upper and lower parts of the cam path are divided, the upper part being formed by two cam projections 18 and 19 and the lower part being formed by further two cam projections 18 and 20.

However, it is also possible in an alternative embodiment, which is to be described later in this specification, to use only cam projections 17 and 18 and to omit the mutually approaching cam projections 19 and 20. It is also possible to form the cam paths as grooves (not shown) in the carrier body 13 of the control mechanism 9, and then to make the upper and lower parts of the cam path continuous. In each case, the bodies forming the beginning of the cam paths, i.e. the parts of the cam paths beginning at the front 21 of control mechanism 9 in the direction of guideway 10 of control mechanism 9, are mutually overlapped as shown in FIG. 6. e.g., the upper part is formed by a cam projection 17, which begins at a lower point than cam projection 18 and also in advance of the latter — the beginning of cam projection 17 is nearer to the front 21 of the control mechanism 9 than the beginning of cam projection 18.

Selecting magnet 14 is mounted in the front side of the carrier body 13 of control mechanism 9 as shown in FIGS. 1 and 2. This selecting magnet consists of at least one permanent magnet and at least one electromagnet which is coupled with a programming device (not shown).

Figure 8:
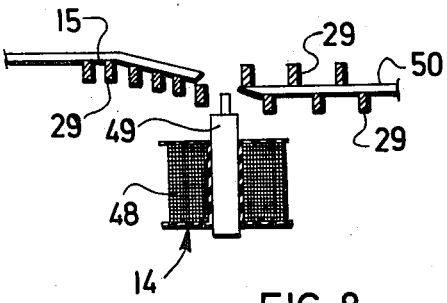
FIG. 8 is a fragmentary plan view of an alternative embodiment of the selecting magnet.
Figure 17:
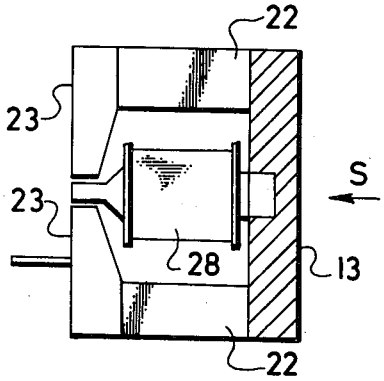
FIG. 17 is a plan view of a selecting magnet in partial section.
Figure 18:
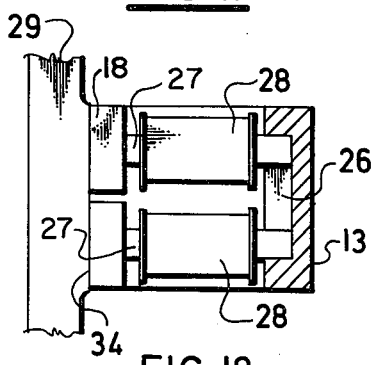
FIG. 18, is side view section through the selecting part of a selecting magnet.
Figure 20:
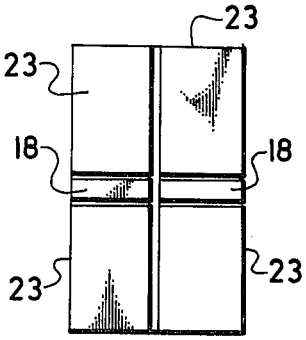
FIG. 20 is a view of the selecting magnet in the direction S shown in FIG. 17.
Figure 19:
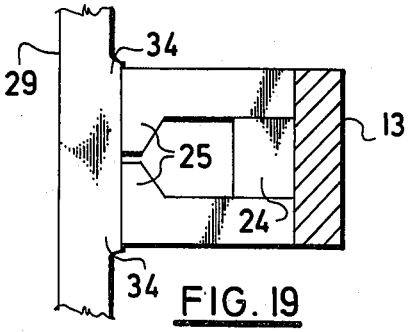
FIG. 19 is a side view section through the retaining part of the selecting magnet.

In the accompanying drawings, a plurality of basic embodiments of selecting magnet 14 are shown. Substantially, the selecting magnet 14 comprises two retaining parts, and one selecting part which is mounted between these retaining parts. The retaining part consists of two permanent magnets 22, each of which is provided with a pole shoe 23 (FIGS. 17, 20). The retaining part may be formed by one permanent magnet 24 having a prismatic form with two pole shoes 25, arranged adjacent to both sides of the magnet 24 as shown in FIG. 19. An advantageous embodiment, shown in FIG. 18, includes a permanent magnet 26 with two pole shoes 18, 27, on each of which is mounted an electromagnetic coil 28 which is connected to a programming device (not shown). One part 27 of the pole shoe simultaneously forms the core of the coil 28 and jointly with the part 18 forms a complete pole shoe. As shown in FIG. 8, it is also possible to use in the device according to the present invention a selecting magnet, consisting only of a selecting part. This selecting part is formed by a coil 48 with a core 49 the front surface of which is rather wider than in the embodiments above described. The guide 15 is thus assigned to the front surface of the core 49 and the other retaining part is replaced by a divider 50, which separates the selected control lifters 29 from the non-selected lifters.

According to the embodiment of the device according to the present invention, shown in FIGS. 2, 3, 10, 14 and 22, each carrier part 4 of the healds 5 is provided with a control lifter 29. Control lifter 29 is connected with carrier part 4 by means of a joint 30 which is swingable in a plane perpendicular to bed 1 in which carrier part 4 is mounted, and thus mediating the connection of healds 5 with the control mechanism 9. Carrier parts 4 and the appurtenant control lifters 29 are thus mutually swingably connected about an axis parallel to bed 1 in which said carrier parts 4 are mounted.

Figure 9:
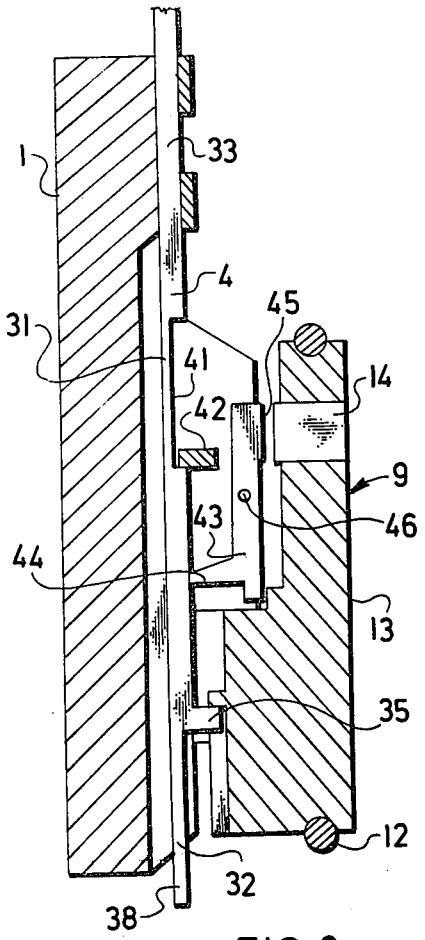
FIGS. 9 and 10 are views in cross section of further alternative embodiments of the apparatus of the invention.

According to another embodiment of the present invention, shown in FIGS. 7 and 9, the carrier part 4 of the healds 5 is extended as far as the range of activity of control mechanism 9. In that case, the carrier part 4 is weakened in its middle part 31 and at least said middle part 31 is made of resilient material. Thus a deviation of the lower part 32 of carrier part 4 is made possible in a plane perpendicular to bed 1 with respect to the upper part 33 of said carrier part 4.

The lower part 32 of carrier part 4 and the lower part of control lifter 29 are made substantially similar. Therefore in the following part of the specification the same parts will be denoted by the same reference numbers and will be described only with respect to the control lifter 29.

Approximately in the middle part of control lifter 29 ther is provided a small step 34 (FIGS. 2,3) forming a surface for contact with the shoes of selecting magnet 14. Below said step 34, (which, however, need not be provided,) a butt 35 is made for contact with cam projections 17 to 20 on the control mechanism. Step 34, and butt 35 as well, are disposed on the side directed towards control mechanism 9.

On the opposite side of the control lifter 29 there is provided a projection 36 for contact with a step 37 on bed 1. The prolonged foot 38 of control lifter 29 is adapted for engagement with guide 15, as shown in FIG. 2.

Figure 3:
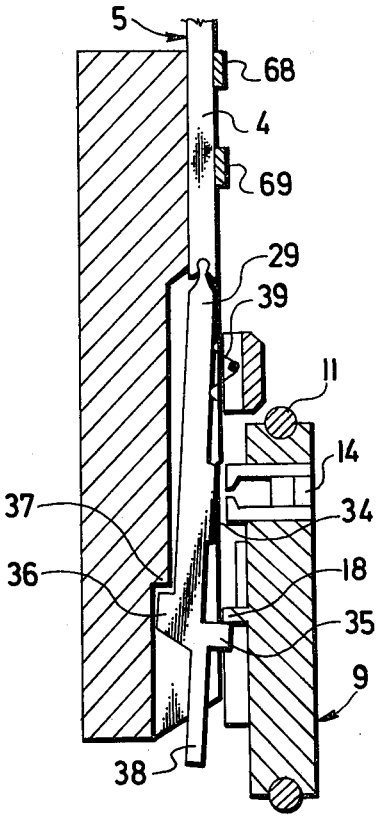
Figure 5:
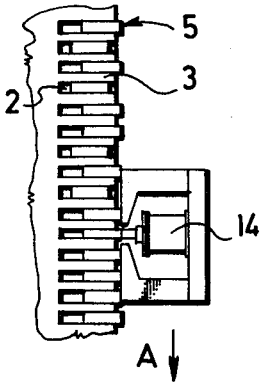
Figure 10:
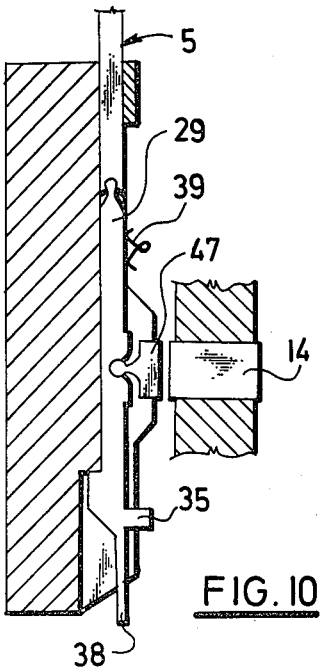

Control lifter 29, shown in FIGS. 2, 3 and 10, is further provided with a shaped spring 39, in alignment with the prolonged carrier part 4 of healds 5 (FIG. 7), said spring being mounted in a stationary holder 40 which extends along the whole width of bed 1. Spring 39 bears against the appurtenant control lifter 29 and presses it towards bed 1.

In FIG. 9 there is shown an alternative embodiment of the prolonged carrier part of the healds with opposite action of the selecting magnet 14 upon this carrier part 4, as will be explained below.

The lower part 32 of said carrier part 4 is not provided with either a step 34, or with a projection 36. Similarly, no step 37 is provided in bed 1. To the lower part 41 in the middle part 31 of carrier part 4 there is attached a shim 42.

This alternative embodiment of carrier part 4 is provided with a two-arm transmission lever 43 (FIG. 9) which with its nose 44 on the lower arm to the lower part 32 of said carrier part and with step 45 on the other arm is assigned to selecting magnet 14. Each carrier part 4 has one associated transmission lever 43 which is pivotally mounted on a pivot pin 46 carried by the carrier body 13 of control mechanism 9.

The control lifter 29, as well as the prolonged carrier part 4, may be provided at the point of step 34 with a hinged lifter 47 ( FIG. 10) for the purpose of providing better contact with the extensions of selecting magnet 14.

Beside the parts already mentioned, each control mechanism is provided with sensing contacts 51, which engage electric conductors arranged parallel to guideway 10 of control mechanism 9. Such electric conductors are either liquids 52, into which the sensing contacts 51 dip as shown in FIG. 21, or metal rods 53, along which said sensing contacts 51 slide (FIG. 1).

Figure 21:
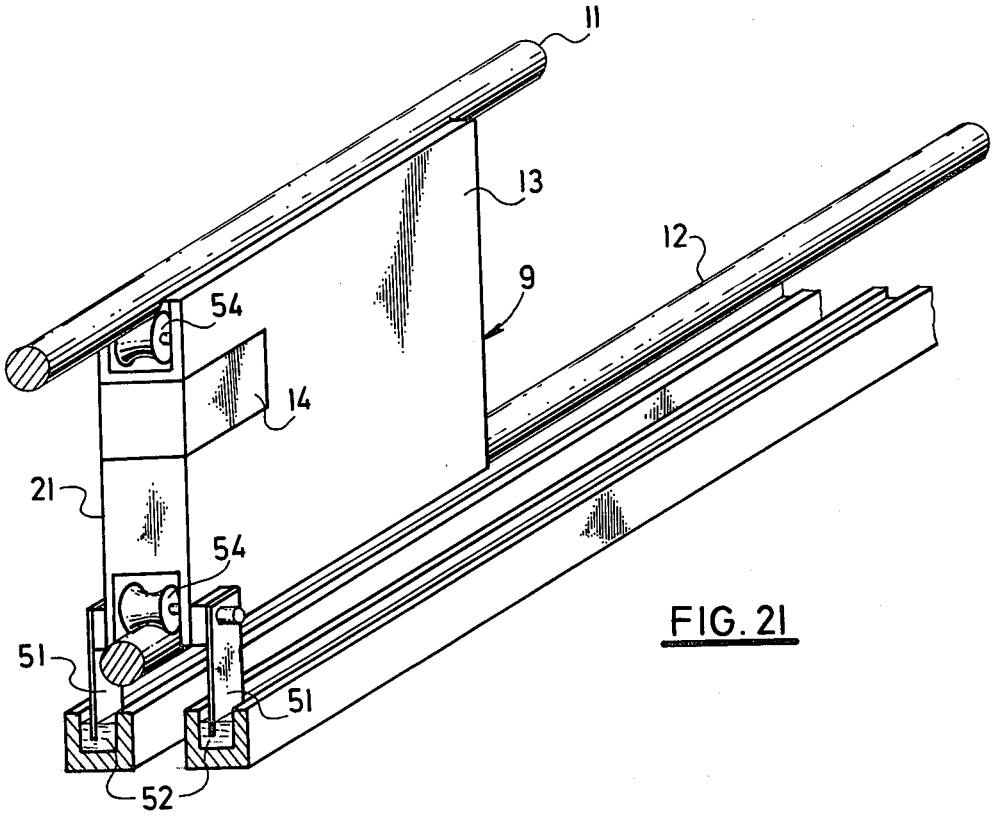
FIG. 21 is a view in perspective of the control mechanism.

Control mechanism 9 may also be provided with a system of guiding rollers 54 at both its upper and lower parts (FIG. 21). Through the intermediary of those rollers 54, said control mechanism 9 is guided about guideway 10, thereby facilitating the guiding of control mechanisms 9 about the reversing archs (not shown) of said guideway 10.

As shown in FIG. 1, control mechanism 9 is also provided with a pull means which is e.g. connected to a driving mechanism at one side of the loom. The pull means may be e.g. a cable 55 or a link chain (not shown). When arranging a plurality of control mechanisms 9 in the machine, it is advantageous to connect the rear part of a control mechanism 9 with the front 21 of the following mechanism 21, or to form an infinite chain or regularly distributed control mechanisms 9.

Figure 16:
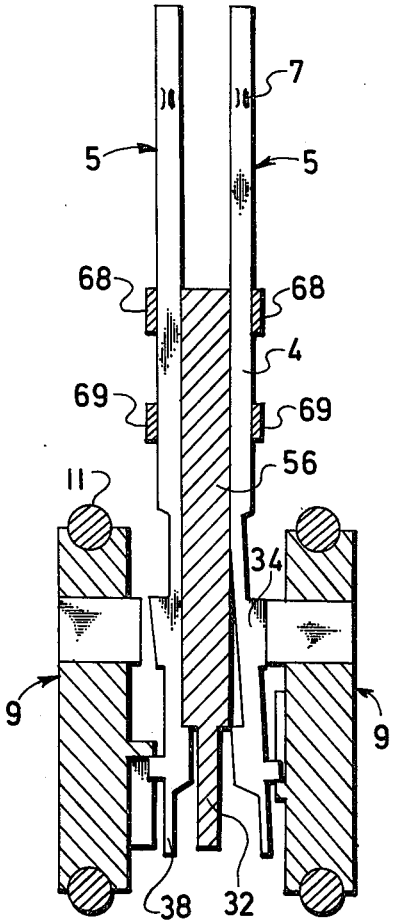
FIG. 16 is a view in cross section through a further embodiment of the device according to the present invention.

The control mechanisms 9 may be also arranged in two rows attached to the front side and the rear side of bed 56, as shown in FIG. 16. This bed 56 is provided with two systems of grooves 2 and healds 5, which are mutually mirror-image arranged in such manner that the healds 5 of one side are situated amidst the pitch of healds 5 of the other side. The bars 68 and 69 on each side of the bed 56 aid in guiding the healds 5. Control mechanisms 9 are also mirror-image arranged and their drive is synchronized. Analogously, it is also possible to arrange them in a plurality of rows.

Cam projections 19 and 20 on carrier body 13 of control mechanism 9 may be omitted. In such case, their operation is replaced by a shaped flat spring 57, which is attached to each heald 5 or carrier part 4, and is anchored in bed 1 or 56 (see FIG. 14). For retaining said flat springs 57, a recess 58 is made in bed 1 or 56. The flat spring 57 presses the appurtenant heald 5 through the intermediary of recess 70 into its central - initial position, in which the appurtenant warp thread 8 passes straight through it.

The healds 5 are secured in the upper or lower position upon forming the appurtenant shed planes by horizontal parts of cam projections 17 and 18. For the same purpose the electromagnets 59 and 60 (FIG. 11) are provided with anchor 61 with front surface 62 corresponding to the shape of front 63 at the upper and lower side of heald 5. One row of electromagnets 59 is thus arranged above healds 5 for securing them in the upper position and the other row of electromagnets 60 is arranged below them for securing them in their lower position. Each heald is shown as being assigned two electromagnets 59 and 60; however, they can also be common for a plurality of healds 5, or in the case of conventional weft insertion, can be used for all healds 5. Each electromagnet 59 or 60 is connected to a programming device (not shown), which transmits electric pulses to the winding of electromagnets 59 or 60 synchronously with the operation of the machine.

The said securing of the position of healds 5 may also be accomplished mechanically. E.g. a recess 64 (FIG. 12) is formed in both the upper and lower part of heald 5, said recess cooperating with retaining detent 65 of a swingable pawl 66 mounted pivotally about pivot shaft 67 which extends across the whole width of bed 1 above healds 5, the number of pawls 66 mounted thereon being equal to the number of healds 5. In the same manner there is arranged a pivot (not shown) below healds 5 for securing them in the lower position. The releasing of pawls 66, upon retaining as well as upon releasing healds 5, may be performed e.g. by stops (not shown), carried by carrier body 13 of control mechanism 9 together with resilient means (not shown) pressing pawls 66 into engagement with recesses 64 of healds 5. It is advantageous, particularly in weaving machines in which the weft is inserted as in conventional weaving looms only after opening the shed across the whole width of the machine, to arrange pawls 66 on pivot shaft 67 so that they can be turned through a certain limited angle, this making possible the simultaneous releasing of all healds by turning the pivot shaft 67.

The embodiment's shed-forming device described above are adapted for selecting warp threads in their middle position, i.e. in a closed shed. In the following, a further arrangement is described which is adapted for the selection of warp threads in their extreme positions, i.e. in an opened shed. Such further embodiment is illustrated in FIGS. 23 - 29, incl.

In such further embodiment, the control mechanism 71 is arranged in the same manner as the control mechanism 9 of the preceding embodiment, that is, displaceably on guiding rods 11, 12 through the intermediary of guiding rollers 54. Healds 5 and their carrier parts 4 are made and deposited in manners similar to those of the preceding embodiment.

Control mechanism 71 includes a carrier body 72, by means of which said control mechanism 71 is mounted on guiding rods 11, 12. To this carrier body 72 there is connected (or forms an integral part therewith) a bent bracket 73 (FIGS. 23, 24). This bent bracket 73 is fixed to the carrier body 72 in its lower part and together with said carrier body 72 there is formed an opened housing of U shaped cross section, the inner wall 74 of carrier body 72 and inner wall 75 of bent bracket 73 being parallel.

Cam paths in this embodiment are formed in such manner that the inclined parts of cam paths parts connect two oppositely mounted parallel most remote parts and cross each other.

In the direction of guideway 10 of control mechanism 71 the selecting magnet 14 and the guiding means assigned thereto are arranged at the point of maximum separation of the cam paths, preferably immediately before the beginning of the inclined parts of said cam paths.

On the inner wall of carrier body 72 and the inner vertical wall of bent bracket 73 there are fastened cam shaped parts defining the cam paths, on the inner wall 74 of carrier body 72 there being a lifting path formed by a lifting wedge 76 and on the inner wall 75 of bent bracket there being a lowering path formed by a lowering wedge 77 and a guiding path formed by a guiding wedge 78. Lifting wedge 76 and lowering wedge 77 are located in such manner in the front elevation of control mechanism 71, that the projections of their inclined operative edges 79, 80 are crossed as shown in FIG. 26. The guiding wedge 78 and lowering wedge 77 form a guiding channel 82 between their inclined operative edges 80, 81.

On the upper guiding edge 83 of lowering wedge 77 there is formed a step by which a projection 84 (FIG. 29) is formed on the side of inner walls 75. The operative edge 79 is oppositely stepped, i.e. the projection 85 is disposed on the side which is opposite the inner wall 74 (FIGS. 24, 27). The operative edges 79, 80 of lifting wedge 76 and lowering wedge 77 are inclined and straight in the illustrated exemplary embodiment. However, it is also possible to make them of cam shape in view of the technological requirements of fabric manufacture, or to eliminate inertial forces of the movable parts of the device.

It is obviously possible to form the cam paths by means other than wedges 76, 77, 78, e.g. by cam shaped projections or by the deepening of cam paths in the inner walls 74, 75.

On the inner wall 75 of bent bracket 73 there is also arranged a guide 86 as shown in FIGS. 26, 23 and 24. In the lower part of each carrier part 4 of healds 5 there is swingably arranged in a manner similar to the embodiment first described above, a control lifter 87, the lower end of which engages an opened housing formed by carrier body 72 and bent bracket 73. However, control sinker 87 differs in its construction from control sinker 29 in the preceding embodiment. The lower part 88 of control lifter 87 is formed by two butts 89, 90, which are located in alignment, but on mutually opposite sides of control lifter 87. Butt 89 is directed toward the inner wall 76 of bent bracket 73, while butt 90 is directed toward the inner wall 74 of carrier body 72, and is, moreover, provided with a retaining detent 91. The length of the lower part 88 of control lifter 87 from butts 89, 90 to foot 92 is at least equal to the distance of the upper guiding edge 93 from guide 86. This guiding edge 93 and the upper guiding edge 83 of lowering wedge 77, together with the projection 94 of the bent bracket 73 form a guiding channel for butts 89.

In the upper part of carrier body 72 there is arranged a selecting magnet 14, which is similar in construction to that of the preceding embodiment. At those points of the control lifter 87 which come into contact with selecting magnet 14 there may be formed projections (not shown) for engagement with the extensions of selecting magnet 14.

A stationary holder 95 is assigned to bed 1 above the path of control mechanisms 71; into holder 95 there are inserted springs 96, each of which cooperates with one control lifter 87 and acts upon it with its elastic force in the direction towards the bottom of the groove 2 (FIG. 24). The shape of spring 96 may also correspond to the shaped spring 39 of the preceding embodiment.

The apparatus according to the first described embodiment of the present invention operates as follows:

Upon operation of the loom, provided with the shed-forming device according to the present invention, the control mechanism 9 is driven by a driving mechanism (not shown) along a system of healds 5 in bed 1. Upon movement of control mechanism 9 in the direction A, guide 15 at first comes into contact with foot 38 of the carrier part 4 of heald 5 or control lifter 29 (FIG. 2). By the effect of operative surface 16 of guide 15 upon feet 38 of control lifters 29, a part of control lifter 29 is moved away from bed 1 against the action of shaped spring 39. In the embodiment having the extended carrier part 4 of heald 5, the lower portion 32 of said part 4 is swung out against the elastic force of the middle part 31 of carrier part 4 as shown in FIG. 7. As a result, step 34 is brought nearer to the pole shoes 23 of permanent magnet 22, which forms a retaining part of selecting magnet 14, the force of said permanent magnet 22 then holding the step 34 in contact with shoes 23. Upon the further operation of control mechanism 9, step 34 comes into contact with pole shoes 19 of selecting part of selecting magnet 14. If at that moment a pulse is received by coil 28 of the selecting part, the effect of the oppositely polarized permanent magnet 26 of this selecting part is weekened and control lifter 29 is separated by action of shaped spring 39 from the selecting magnet 14.

In the alternative embodiment having a prolonged carrier part 4 of healds 5, it is moved away by the action of the resilient middle part 31 of that carrier part. The projection 36 thereby gets below step 37 in bed 1, thus assuring that this control lifter 29 cannot be lifted into a higher position. When control mechanism 9 carries on its movement in the direction A, butt 35 of control lifter 29 comes into engagement with cam projection 18 (FIG. 3), which is higher than cam projection 17, and thereby the control lifter 29 and its appurtenant heald 5 or group of healds 5 are retracted into the lower position. The appurtenant warp thread 8 or warp threads 8 thus form the lower plane of the shed.

If, on the other hand, at the moment of passage of step 34 in front of the selecting part of selective magnet 14 no pulse is supplied to coil 28 of the selecting part, permanent magnet 26 of the selecting part retains control lifter 29 in contact with selecting magnet 14. In the further phase, butt 35 of control lifter 29 is retained by cam projection 17. Thus, the control lifter 29 and the appurtenant heald or healds 5 are lifted into the upper position, in which the appurtenant warp thread 8 forms the upper plane of the shed. The engagement of cam projection 17 with butt 35 is secured by the bearing of projection 36 against the bottom of groove 2.

When using a selecting magnet 14 including only a selecting part, the selection is performed similarly; after selection the control lifter 29 is retained for engagement with cam projection 17 by separator 50 instead of the retaining part of selecting magnet 14.

The opening of the shed is secured by the horizontal part of cam projections 17 and 18, about which, upon movement of the control mechanism the butts 35 slide. This kind of securing is particularly adapted for looms with progressing sheds, in which the weft threads are inserted successively behind each other in the separate shed waves.

Figure 11:
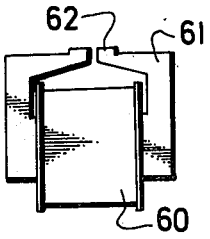
FIGS. 11 and 12 are views in cross section of the mechanism for retaining healds in a predetermined position.
Figure 12:
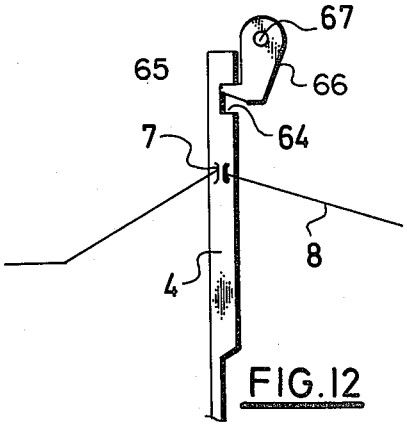
Figure 15:
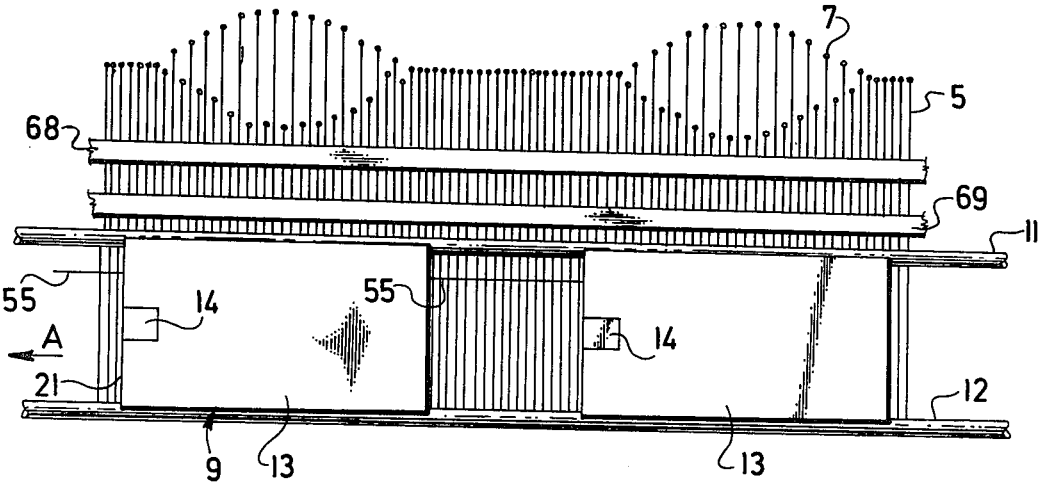
FIG. 15 is a view in front elevation of the control mechanisms arranged behind each other.
Figure 14:
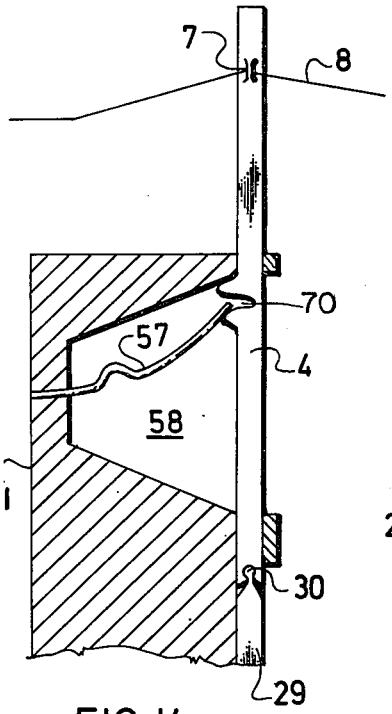
FIG. 14 is a view in cross section through the bed with a return spring.

Another possible securing of the position of healds 5 is their being retained by magnetic force of electromagnets 59, 60 which are supplied synchronously with the advancement of control mechanism 9 as shown in FIG. 11. It is also possible to retain healds 5 mechanically by pawls 66 (FIG. 12). Both last mentioned embodiments may be used in a loom for successive insertion of a plurality of wefts one after another, as well as in a loom in which the weft is inserted in a conventional manner after opening the shed along the whole width of the machine. The healds 5 are returned back into the initial position either by the action of cam projections 19, 20 upon butts 35 or by action of the shaped flat spring 57. In the initial position, healds 5 remain as long as the following control mechanism 9 is at their level (FIG. 15). Upon the passage of each control mechanism 9, the operation of the device according to the present invention is repeated in the manner described above. Control mechanisms 9 preferably move continuously at a constant speed in the direction A. However, it is also possible to provide a reverse drive for control mechanisms 9. In that case, each control mechanism 9 controls only healds 5 in a ceratin section of the machine width for movement in the direction A and upon reverse motion in the opposite direction, guideway 10 is retracted together with control mechanisms 9 from bed 1. After distributing healds 5 into the upper or lower position, said healds are retained either by electromagnets 59, 60 or pawls 65 and are released only after distributing all healds 5 and following weft insertion.

The alternative embodiment of the apparatus according to the present invention illustrated in FIGS. 23 - 29, incl., in which the selection of warp threads is performed in their extreme positions, operates as follows:

Control mechanism 71 is driven by the same means as control mechanism 9 according to the preceding embodiment in the direction A by a continuous motion along a system of control lifters 87 in bed 1. Control lifters 87 are guided with their butts 89, on one hand, below guiding wedge 78 (the appurtenant healds 5 then hold warp threads 8 in the upper plane of the shed).

By the action of guide 86, all control lifters 87 are pressed against the selection magnet 14, which is fed in the same manner as in the preceding embodiment. At the moment of selection, the control lifter 87 is held either in the upper or in the lower position by the passive resistance forces of the mounting in grooves 2. It is also possible to provide a recess (not shown) in the upper guiding edge 93 and in the lower guiding edge of guiding wedge 78 for the purpose of reliable retention by selection magnet 14 of the released control lifters 87.

If the selection magnet 14 retains a control lifter 87 which is situated in its upper position, the beginning of projection 84 of lowering wedge 77 passes through the point of its deposition. Upon passage of selection magnet 14, control lifter 87 is pressed by means of spring 96 and butt 89 to the wall of said projection 84. Thus control lifter 87 is further guided in its upper position by the upper guiding edge 83 of lowering wedge 77 (FIG. 29).

When control lifter 87 is released from its upper position upon selection by selection magnet 14, the appurtenant spring 96 presses said control lifter 87 by butt 89 as far as the bottom of the channel between the upper guidin gedge 93 of guiding wedge 78 and projection 94 of bent bracket 73, as shown in the upper part of FIG. 28. Butt 89 is then retained by projection 84 of lowering wedge 77, and the operative edge 79 of said lowering edge 77 then retracts control lifter 87 into its lower position.

When the selection magnet 14 retains a control lifter 87 in its lower position, butt 90 is retained upon further operation of control mechanism 71 by the operative edge 89 of lifting wedge 76, and control lifter 87 is lifted into its upper position. Butt 90 is held in engagement with the operative edge 80 by cooperation of its retaining detent 91 and projection 85 of the lifting wedge 76.

If, upon selection the selecting magnet 14 releases control lifter 87 in its lower position, the appurtenant spring 96 presses said control lifter 87 back below guiding wedge 78. Said control lifter 87 is held further in its lower position by this guiding wedge 78, and further by the lower guiding edge of lowering wedge 77.

Upon transition between the separate control mechanisms 71, control lifters 87 are secured against undesired motion by passive resistance forces of deposition of grooves 2, or by devices similar to electromagnets 59, 60 or retaining detents 65 of the preceding embodiment.

The present invention is not restricted to looms with progressive shed forming, but may also be used in all types of single shed looms.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. In a loom having means for forming and progressively feeding a sheath of warp threads, means for forming sheds in the warp threads, said last-named means comprising a bed extending across the width of the loom, a plurality of parallel guiding grooves formed in the bed, a plurality of healds having carrier parts, at least the carrier parts of the healds being displaceably mounted in the guiding grooves in the bed, a mechanism for controlling the carrier parts of the heald, a guideway disposed parallel to the bed, and means for displaceably mounting the control mechanism in the guideway, the improvement wherein the control mechanism comprises a selecting magnet supported directly therein for movement therewith, the selecting magnet being cooperable with the carrier parts of successive healds disposed in the path of movement of the selecting magnet during the movement of the control mechanism in the guideway for selectively displacing the carrier parts of such healds.

2. A loom as claimed in claim 1, wherein the control mechanism includes a resetting mechanism.

3. A loom as claimed in claim 1, wherein the selecting magnet is formed by a combination of at least one permanent magnet and at least one electromagnet and a programming device coupled to the electromagnet.

4. A loom as claimed in claim 2, wherein the resetting mechanism is formed by cam paths disposed on the control mechanism at the part thereof directed toward the plane of movement of the healds.

5. A loom as claimed in claim 4, wherein the cam paths have a common section in their middle position, from which they diverge in the direction of the guideway of the control mechanism into both upper and lower positions, the cam paths thereafter converging into a common middle position.

6. A loom as claimed in claim 4, wherein the inclined parts of the cam paths connect two opposite, parallel most distant parts and cross each other.

7. A loom as claimed in claim 5, wherein the selecting magnet and the guide therefor are arranged at the point of the common section of cam paths in the middle position.

8. A loom as claimed in claim 6, wherein in the direction of the guideway for the control mechanism the selecting magnet and the guiding means therefor are arranged at the point of maximum separation of the cam paths.

9. A loom as claimed in claim 8, wherein the selecting magnet together with the guiding means therefor are arranged immediately in front of the initial parts of the inclined parts of the cam paths.

10. A loom as claimed in claim 2, wherein the control mechanism includes a carrier body and a bent bracket fastened thereto of which the confronting walls are parallel, and the resetting mechanism is formed by cam paths arranged on two opposite inner walls of the control mechanism, a control lifter, the lower part of the control lifter being provided with two mutually oppositely directed butts engaging between the confronting walls.

11. A loom as claimed in claim 10, wherein on one confronting wall of the control mechanism there is arranged a lifting path and the selecting magnet, while on the opposite confronting wall there is arranged a lowering path and a guiding path.

12. A loom as claimed in claim 11, wherein the lowering path is provided at its upper part with a step.

13. A loom as claimed in claim 10, wherein the lifting path in its operative part is provided with a projection which corresponds in shape to a retaining detent of a butt of the control lifter directed thereto.

14. A loom as claimed in claim 1, wherein each carrier part of the healds is provided with at least one heald.

15. A loom as claimed in claim 14, wherein each carrier part of the healds is provided with a group of healds through the intermediary of a carrier disposed perpendicular to the said carrier part.

16. A loom as claimed in claim 14, wherein the healds and the appurtenant carrier part form a single part.

17. A loom as claimed in claim 1, wherein the carrier part is weakened in its middle part and that at least said middle part is made of resilient material.

18. A loom as claimed in claim 1, wherein each carrier part of the healds is provided with a control lifter which forms a part of its connection with the control mechanism.

19. A loom as claimed in claim 17, wherein the carrier part and the appurtenant control lifter are connected swingably about an axis parallel to the bed in which said carrier parts are mounted.

20. A loom as claimed in claim 1, wherein each carrier part of the healds is provided with at least one spring, acting upon said carrier part in the direction towards its middle position wherein the warp thread passes straight through it.

21. A loom as claimed in claim 1, wherein the control mechanism is provided with sensing contacts which are in contact with electric conductors mounted parallel to the guideway of the control mechanism.

22. A loom as claimed in claim 21, wherein the electric conductor is a liquid into which the sensing contacts of the control mechanism dip.

23. A loom as claimed in claim 1, wherein each control mechanism is provided with a pulling means connected with a driving means.

24. A loom as claimed in claim 4, wherein cam paths of the resetting mechanism are formed by cam projections the initial parts of which are overlapped in the direction of the guideway for the control mechanism.

25. A loom as claimed in claim 4, wherein the cam paths of the resetting mechanism are formed by two cam projections which move away from each other in the direction from the front to the rear end of the control mechanism, are substantially parallel in the middle part, and approach each other in the rear part.

* * * * *